United States Patent [19]

Shill

[11] Patent Number: 5,039,081

[45] Date of Patent: Aug. 13, 1991

[54] SQUARING AND ALIGNING ASSEMBLY FOR A CORRUGATED SHEET UNSTACKING AND FEEDING APPARATUS

[75] Inventor: David Shill, Spokane, Wash.

[73] Assignee: Thermoguard Equipment, Inc., Spokane, Wash.

[21] Appl. No.: 522,678

[22] Filed: May 11, 1990

[51] Int. Cl.[5] ..... B65H 1/22

[52] U.S. Cl. ..... 271/151; 271/186; 271/222; 414/790.2; 414/796; 414/907

[58] Field of Search ..... 271/149, 150, 151, 184, 271/185, 186, 221, 222; 414/790.2, 796, 796.4, 907; 294/119.1, 67.33; 198/456

[56] References Cited

U.S. PATENT DOCUMENTS 4,541,763 9/1985 Chandhoke et al. ..... 414/907 X 4,700,941 10/1987 Shill ..... 271/151

FOREIGN PATENT DOCUMENTS 3712939 11/1988 Fed. Rep. of Germany ... 414/790.2

*Primary Examiner*—H. Grant Skaggs

*Assistant Examiner*—C. Druzbick

*Attorney, Agent, or Firm*—Wells, St. John & Roberts

[57] ABSTRACT

A squaring and aligning assembly for the transfer frame of a corrugated sheet stacking and feeding apparatus is mounted within a transverse guide member in the form of an elongated channel. Separate squaring shoes at each side of the machine are selectively moved along the channel. They can be connected in centered positions along opposite flights of a powered chain to center a block of sheets relative to the machine. One can be connected to a chain flight in an off-center position to align the block of sheets in an off-centered aligned condition. Either shoe can be clamped to the channel for edge alignment in response to movement of the remaining shoe.

3 Claims, 4 Drawing Sheets

SQUARING AND ALIGNING ASSEMBLY FOR A CORRUGATED SHEET UNSTACKING AND FEEDING APPARATUS

TECHNICAL FIELD

The apparatus described herein pertains to the unstacking and prefeeding of flat corrugated sheets in a shingled pattern along a moving path.

BACKGROUND OF THE INVENTION

In the manufacture of corrugated paper cartons or boxes, rectangular corrugated sheets or blanks are first produced in a machine known as a corrugator. The sheets are then stacked for storage and handling purposes. They are subsequently individually processed through a printer or a die cutter that either imprints each sheet or forms carton blanks machine to the requirements of a customer.

Printing machines and die cutters operate at very high rates of speed. Simply loading successive vertical stacks of the corrugated sheets into an infeed hopper for such a machine is ineffective because of the amount of physical labor required to place each stack accurately within the hopper. The amount of labor required would result in an interruption of the operation of the machinery being fed or running the machine at a reduced rate of speed.

The present machine and method assure that a continuous supply or corrugated sheets is maintained within the infeed hopper of a printing machine or a die cutting machine while operating at a high rate of speed. This is accomplished by unstacking the corrugated sheets and pre-feeding them to the receiving hopper of the sheet processing machinery in a continuous shingled manner at a delivery rate that will not interrupt operation of the sheet processing machinery.

Where the incoming sheets or blanks are handled in very large stacks, it has been found advisable to design machines that initially divide each stack into a plurality of smaller "blocks" which are then successively handled and shingled along a longitudinal path leading to the blank processing machinery being fed. After being divided, each block might be inverted or simply deposited on a feed conveyor leading to a shingle gate.

The division of a large stack of corrugated sheets or blanks into several equally-sized blocks requires accurate squaring and alignment of the side edges of each block after it has been divided from the stack and deposited on the receiving end of a moving conveyor. Such side alignment is critical to the subsequent shingling and pre-feeding operations.

Because a pre-feeding machine must meet infeed requirements of a variety of downstream machines, versatile alignment capabilities are required.

The present disclosure utilizes a novel movable support assembly for laterally movable squaring shoes. Each shoe can be adjustably connected to opposed flights of a chain to square and align the block edges along a centerline on the machine or off-center from the centerline, as well as along a side edge of the block.

BRIEF DESCRIPTION OF THE DRAWINGS

The preferred embodiment of the invention is illustrated in the accompanying drawings, in which:

FIG. 9 is a plan view of the squaring shoe assembly;

DETAILED DESCRIPTION OF THE PREFERRED EMBODIMENT

Figure 1:
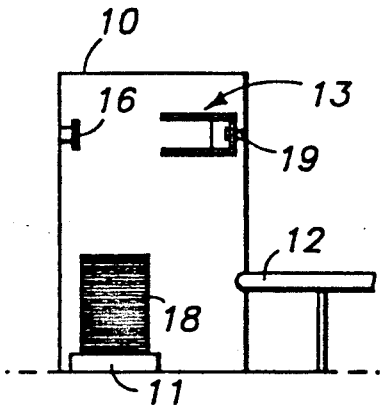
FIG. 1 is a schematic side view illustrating receipt of a stack of sheets.

The following disclosure of the invention is submitted in furtherance with the constitutional purpose of the Patent Laws "to promote the progress of science and useful arts" (Article 1, Section 8).

The machine shown in the drawings is designed for unstacking and pre-feeding of corrugated sheets. It works from vertical stacks in which such sheets are stored and handled prior to use in high speed processing machines relating to production of corrugated paperboard cartons, such as printers or die cutters. The illustrated machine directs the sheets in a shingled manner along a longitudinal path on a feed conveyor that leads to the infeed hopper (not shown) of the downstream processing machinery.

FIGS. 1-6 diagrammatically illustrate the general operation of the sheet pre-feeding equipment to which this disclosure is directed.

In FIG. 1, a stack 18 of sheets is received on a vertically movable elevator 11. Elevator 11 is also transversely adjustable relative to the longitudinal path of the feed conveyor 12 to initially position the stack 18 laterally across the longitudinal path of the sheets on the feed conveyor 12. Such transverse positioning might be referenced to the centerline of the machine, to an off-center line or to a reference edge.

Figure 2:
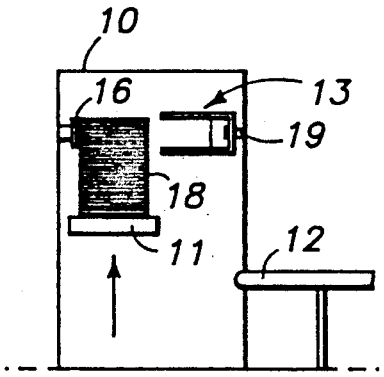
FIG. 2 is a similar view showing an elevated stack.

After being received and transversely positioned, stack 18 is raised elevationally by operation of elevator 11 to a block discharge position (FIG. 2). At this position, the uppermost sheets in the stack 18 are arranged between a block pusher 16 and the open throat of an inverter frame 13.

Figure 3:
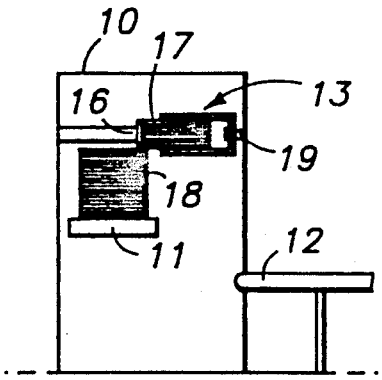
FIG. 3 is a similar view showing a block being shifted into an inverter.
Figure 4:
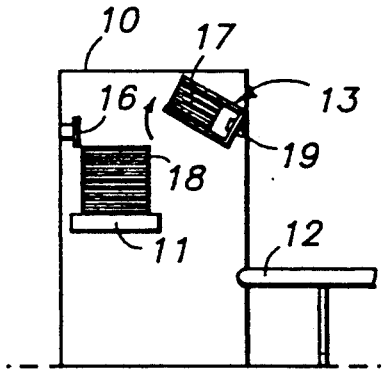
FIG. 4 is a similar view showing pivotal movement of the inverter.
Figure 5:
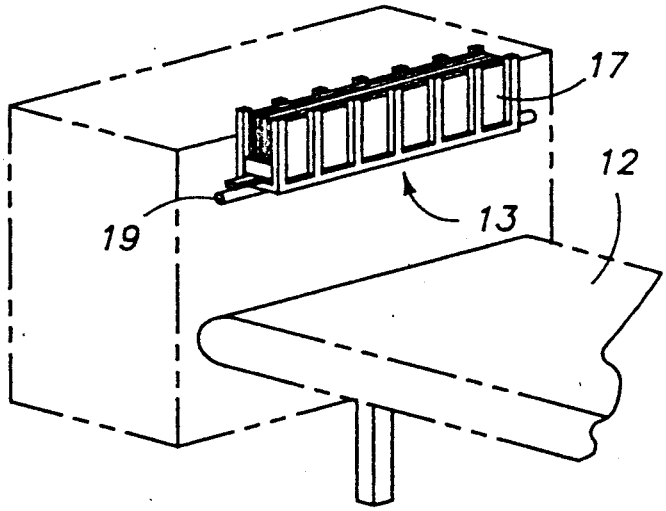
FIG. 5 is a schematic perspective view of the inverter in an upright position.

Block pusher 16 shifts each block of sheets 17 into a movable inverter frame 13, as shown in FIG. 3. The inverter frame 13 then swings 180 degrees about a pivot shaft 19 on framework 10, as shown in FIG. 4. FIG. 5 illustrates its vertical position during such swinging motion.

Figure 6:
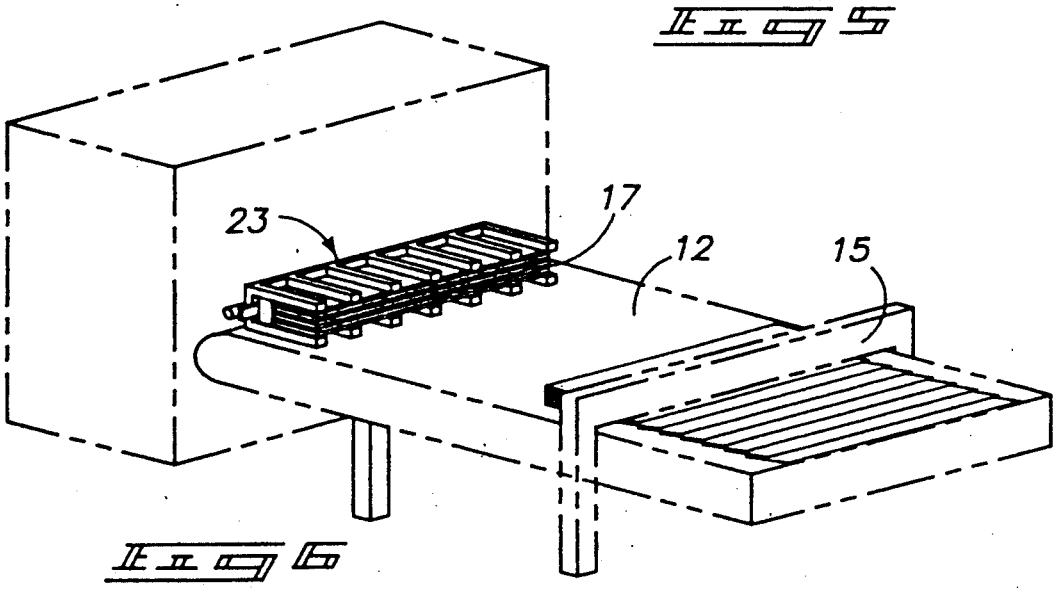
FIG. 6 is a similar view showing the inverter in a lowered position.

The inverted block is then lowered elevationally in preparation for discharge of the block 17 on the receiving end of feed conveyor 12 (FIG. 6). The sheets in each block subsequently engage a transverse shingle gate 15. They are drawn beneath the shingle gate 15 in overlapping, shingled array, illustrated to the right in FIG. 6.

Figure 7:
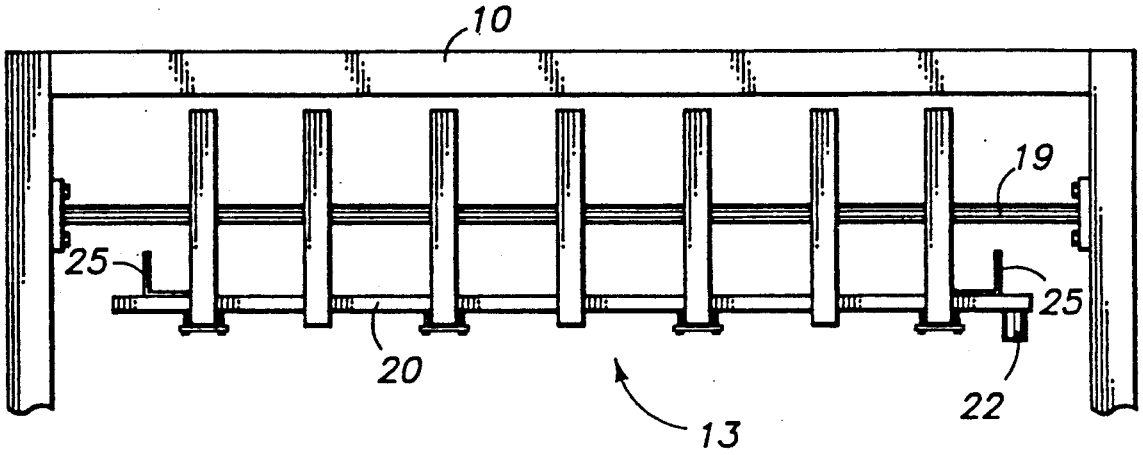
FIG. 7 is a front elevation view of the inverter in the position shown in FIG. 5.
Figure 8:
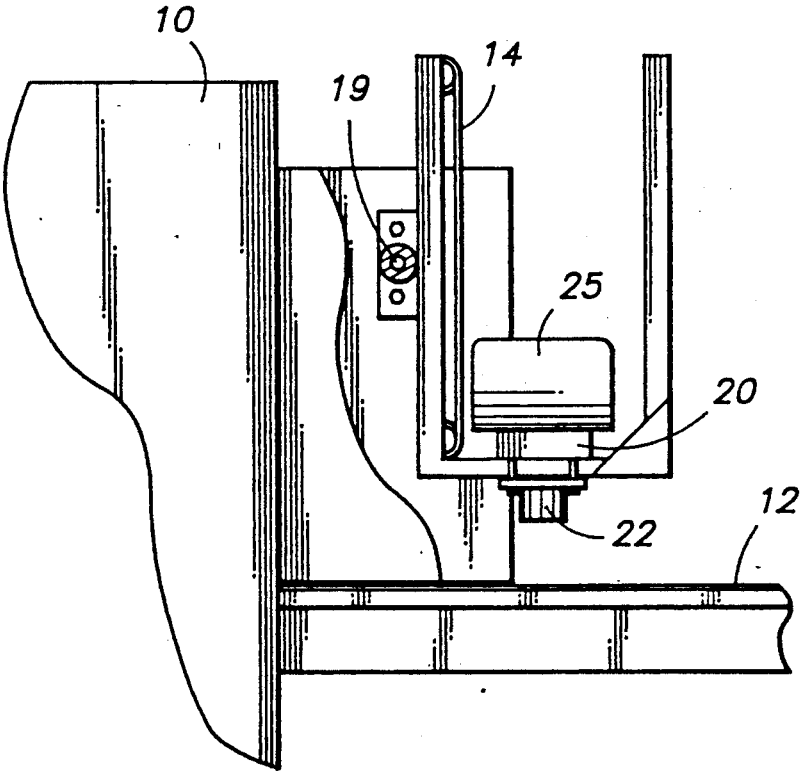
FIG. 8 is an enlarged end view of the inverter in FIG. 7.
Figure 5:
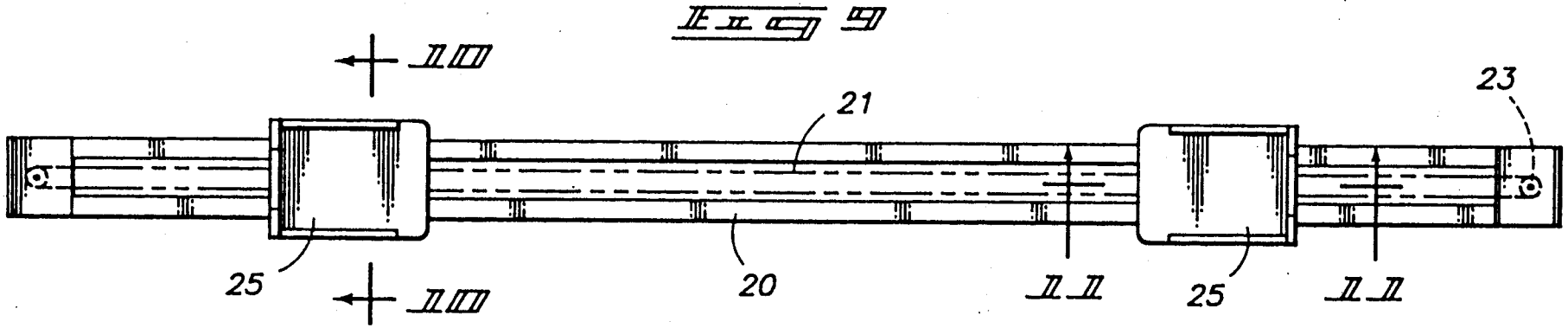

The inverter frame 13 schematically illustrated in FIGS. 1–6, and shown in greater detail in FIGS. 7 and 8 serves as a block transfer frame that is movable with respect to the elongated feed conveyor 12 from a first position adapted to receive a block 17 of sheets to a second position in which the block of sheets is delivered onto the receiving end of feed conveyor 12.

It is to be understood that the present squaring and aligning assembly for the block 17 can be utilized on any block transfer frame that moves a block of sheets separated from an incoming stack and deposits the block of sheets onto the receiving end of feed conveyor 12. The illustrated frame 13 inverts each block 17 as it is being transferred between stack 18 and feed conveyor 12. However, where inversion is not required by subsequent sheet processing equipment, the block transfer frame can be an elevator frame (not shown) vertically movable on framework 10 to shift the block 17 elevationally as necessary in the block transfer procedure. Where design of the machine permits, the blocks 17 can be fed directly onto the receiving end of feed conveyor 12.

A pair of transversely movable squaring shoes 25 at each side of the inverter frame 13 engage the side edges of the sheets within block 17 for aligning the edges of the sheets with each other. They also square the aligned edges of each block 17 with the longitindual path of the machine while positioning the block of sheets laterally across the longitudinal path.

The inverter frame 13 includes parallel conveyor belts 14 along its lowermost side in the position schematically shown in FIG. 2. The belts 14 shift each block 17 of sheets longitudinally along the path of the machine and into the throat of the inverter frame 13 in preparation for its inversion.

The details of the squaring and aligning assembly are best understood from a study of FIGS. 9–12, which illustrate the assembly apart from a block transfer frame on which it would be used (as illustrated in FIGS. 7 and 8).

The squaring and aligning assembly is supported along a fixed channel 20 adapted to be secured to the block transfer frame with which it is utilized. Channel 20 houses an endless elongated chain 21 powered by a motor shown at 22 through a drive sprocket 23 at one end of channel 20 and a complementary idler sprocket at its remaining end. Protruding upright plates of two opposed squaring shoes 25 are slidably mounted along the open upper edges of channel 20 by guide blocks 26. The guide blocks 26 are made of low friction material. They serve as bearings to permit free translational movement of each squaring shoe 25 relative to channel 20 as required.

The chain 21 has oppositely moving parallel flights. Each flight includes an elongated chain joint 27 (FIGS. 10 and 12) that can be selectively bolted to one squaring shoe 25. As illustrated, the chain joint 27 has a plurality of aligned apertures 28 formed through it. The bolt 29 that connects chain joint 27 to a squaring shoe 25 can be received within a selected aperture 28, depending upon the center position desired for block 17 across the longitudinal path of the equipment.

Figure 13:
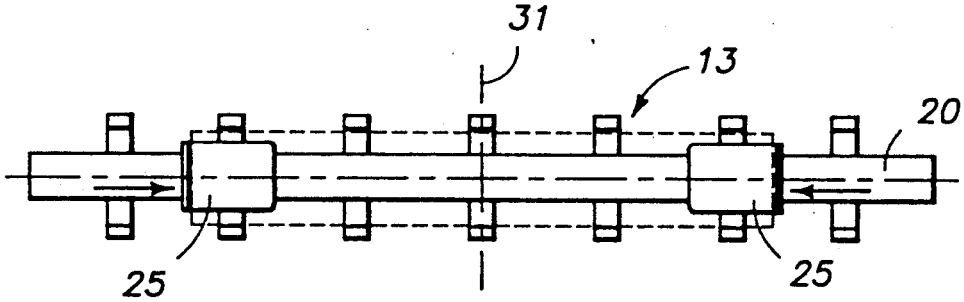
FIG. 13 is a schematic top view illustrating operation of the squaring shoes for centering a block of sheets.
Figure 14:
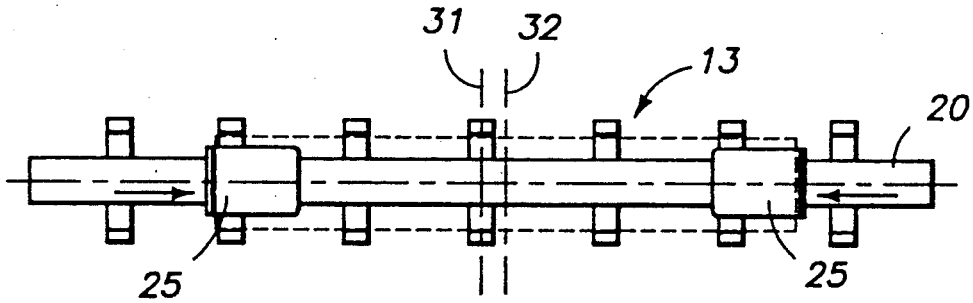
FIG. 14 is a schematic top view illustrating operation of the squaring shoes for aligning a block of sheets off-center.
Figure 15:
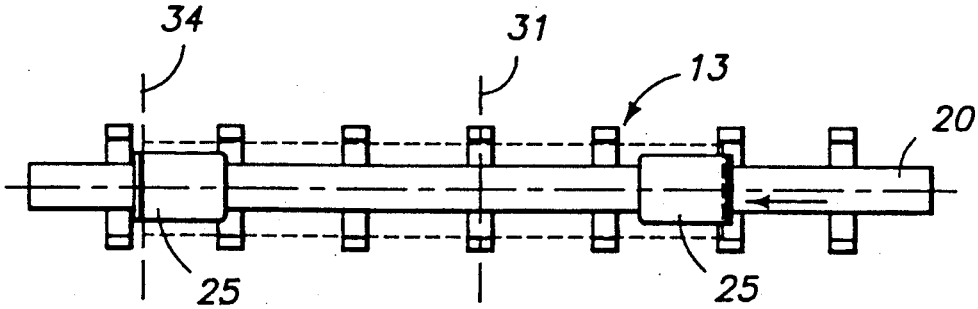
FIG. 15 is a schematic top view illustrating operation of the squaring shoes for aligning a block of sheets to one edge.

FIGS. 13, 14 and 15 schematically illustrate the several possibilities available with respect to aligning the block of sheets 17 across the longitudinal path of the machine, whose centerline is illustrated by line 31.

In FIG. 13, each squaring shoe 25 is connected to chain joint 24 through an aperture 28 identically spaced to each side of centerline 31. As the motor 22 powers chain 21 to move squaring shoes 25 inwardly, they will engage the side edges of block 17 and position the block laterally across the longitudinal path of the machine in a centered position relative to the centerline 31.

Where off-center alignment is required by downstream eqiupment, this can be achieved by offsetting the connection of one squaring shoe 25 relative to the other. The selected aperture 28 for bolt 29 would then be separated from the centerline 31 by a greater or smaller distance than the selected aperture for the remaining squaring shoe 25. As the chain 21 brings the squaring shoes together, the centerline of the block 17 will be aligned off-center, as indicated by line 32 in FIG. 14.

Figure 11:
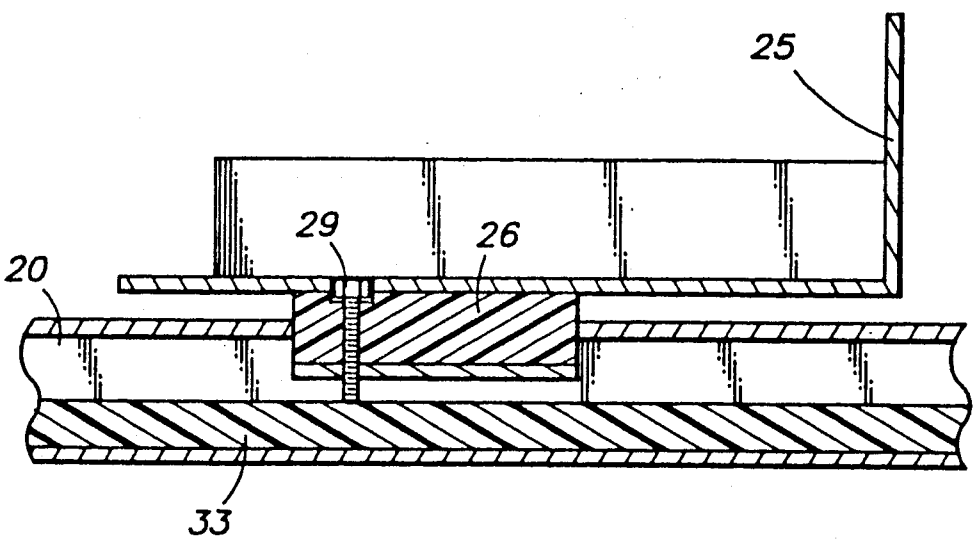
FIG. 11 is a sectional view taken along line 11—11 in FIG. 9.
Figure 10:
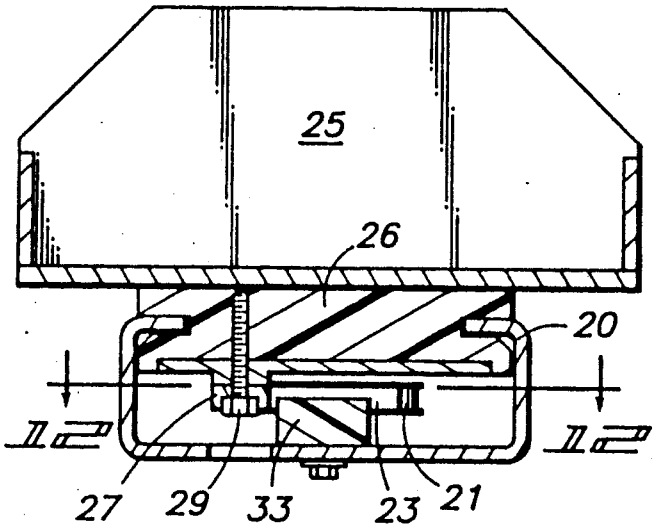
FIG. 10 is a sectional view taken along line 10—10 in FIG. 9.
Figure 12:
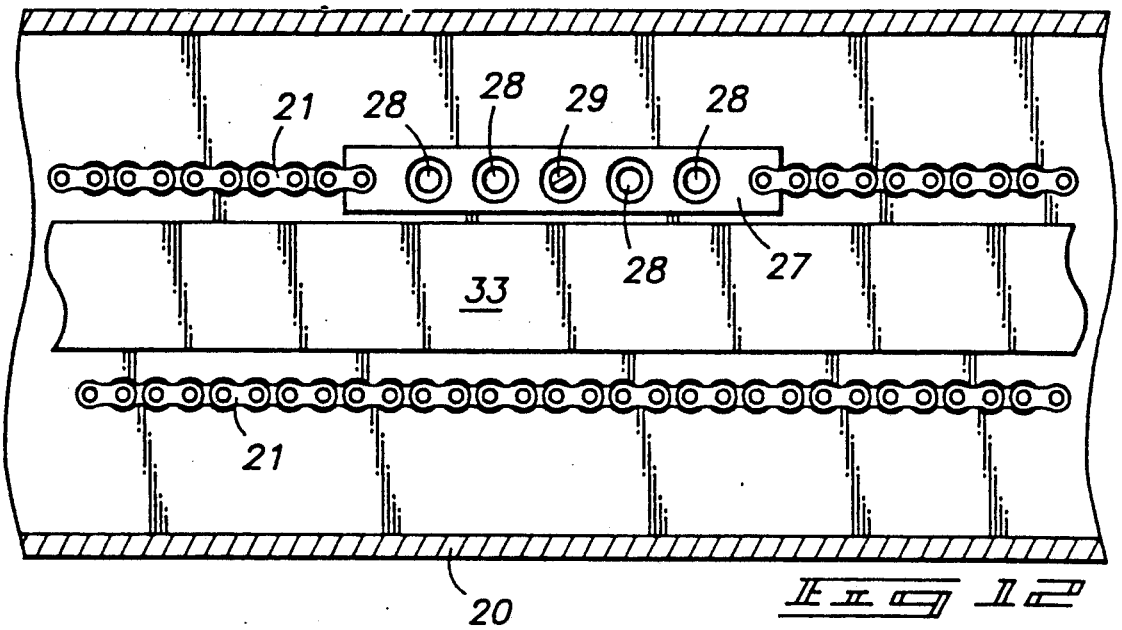
FIG. 12 is a sectional view taken along line 12—12 in FIG. 10.

Because some downstream machines require alignment of block 17 to an edge, rather than to the centerline of the machinery, provision is made for accommodating such requirements in the illustrated squaring and alignment assembly. This can be accomplished by disconnecting one squaring shoe 25 from its associated chain joint 27 and fixing the squaring shoe 25 in the desired edge position. As can be seen in FIG. 11, the guide block 26 of each squaring shoe 25 can threadably receive the removed bolt 29, which then bears against an elongated strip 33 fixed along the center of channel 21 to clamp guide block 26 to channel 20 at any desired location along the length of the channel. The reamining squaring shoe 25 will continue to be powered transversely to urge the block 17 against the stationary squaring shoe 25 for edge alignment along a line 34, as illustrated in FIG. 15.

In compliance with the state, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine or equivalents.

I claim:

1. A corrugated sheet unstacking and feeding apparatus that removes sheets from a vertical stack and feeds them along a longitudinal path; comprising:

a powered elongated feed conveyor extending along the longitudinal path and having a receiving end;

a block transfer frame movable with respect to the elongated feed conveyor from a first position adapted to receive a block of sheets to a second position in which the block of sheets is deposited on the receiving end of the feed conveyor;

the block transfer frame including a transverse guide member;

a pair of laterally opposed squaring shoes mounted to the guide member;

drive means within the guide member and operably connected to at least one squaring shoe for selectively imparting relative movement between the squaring shoes across the block transfer frame for (1) aligning the edges of the sheets within a block with each other on the block transfer frame, (2)

squaring the alinged edges of the sheets with the longitudinal path, and (3) positioning the block of sheets laterally across the longitudinal path;

the drive means including an endless chain having oppositely moving parallel flights; and each flight of the chain including a chain joint adapted to be releasably connected to one of the squaring shoes.

2. A corrugated sheet unstacking and feeding apparatus that removes sheets from a vertical stack and feeds them along a longitudinal path; comprising:

a powered elongated feed conveyor extending along the longitudinal path and having a receiving end;

a block transfer frame movable with respect to the elongated feed conveyor from a first position adapted to receive a block of sheets to a second position in which the block of sheets is deposited on the receiving end of the feed conveyor;

the block transfer frame including a transverse guide member;

a pair of laterally opposed squaring shoes mounted to the guide member;

drive means within the guide member and operably connected to at least one squaring shoe for selectively imparting relative movement between the squaring shoes across the block transfer frame for (1) aligning the edges of the sheets within a block with each other on the block transfer frame, (2) squaring the aligned edges of the sheets with the longitudinal path, and (3) positioning the block of sheets laterally across the longitudinal path;

the drive means including an endless chain having oppositely moving parallel flights; and each flight of the chain including a chain joint adpated to be releasably connected to one of the squaring shoes at a selected adjustable location along the length of the chain flight.

3. A corrugated sheet unstacking and feeding apparatus that removes sheets from a vertical stack and feeds them along a longitudinal path; comprising:

a powered elongated feed conveyor extending along the longitudinal path and having a recieving end;

a block transfer frame movable with respect to the elongated feed conveyor from a first position adapted to receive a block of sheets to a second position in which the block of sheets is deposited on the receiving end of the feed conveyor;

the block transfer frame including a transverse guide member;

a pair of laterally opposed squaring shoes mounted to the guide member;

drive means within the guide member and operably connected to at least one squaring shoe for selectively imparting relative movement between the squaring shoes across the block transfer frame for (1) aligning the edges of the sheets within a block with each other on the block transfer frame, (2) squaring the alinged edges of the sheets with the longitudinal path, and (3) positioning the block of sheets laterally across the longitudinal path; and releasable means on the guide member and each squaring shoe for selectively locking the squaring shoe to the guide member at a fixed position.

* * * * *